US008461469B2

(12) United States Patent
Engemann et al.

(10) Patent No.: US 8,461,469 B2
(45) Date of Patent: Jun. 11, 2013

(54) DRIVE APPARATUS FOR A TENSIONING SHAFT OF A SPRING ENERGY DRIVE OF AN ELECTRIC SWITCH AND ELECTRIC SWITCH WITH SUCH A DRIVE APPARATUS

(75) Inventors: Burkhard Engemann, Berlin (DE); Ralph Hohenberger, Brieselang (DE)

(73) Assignee: Siemens Aktiengesellschaft, Munich (DE)

( * ) Notice: Subject to any disclaimer, the term of this patent is extended or adjusted under 35 U.S.C. 154(b) by 230 days.

(21) Appl. No.: 13/042,667

(22) Filed: Mar. 8, 2011

(65) Prior Publication Data

US 2011/0226074 A1 Sep. 22, 2011

(30) Foreign Application Priority Data

Mar. 18, 2010 (DE) ..... 10 2010 011 997

(51) Int. Cl.
*H01H 5/00* (2006.01)

(52) U.S. Cl.
USPC ..... 200/400

(58) Field of Classification Search
USPC ..... 200/400, 401, 318–327, 332, 50.01, 200/244, 239, 250
See application file for complete search history.

(56) References Cited

U.S. PATENT DOCUMENTS 4,152,561 A 5/1979 Maier et al. ..... 200/153 G
4,649,244 A 3/1987 Baginski et al. ..... 200/153 S C
6,144,002 A * 11/2000 Coudert et al. ..... 200/400
6,506,990 B2 * 1/2003 Marin-Pache et al. ..... 200/400
7,009,129 B2 * 3/2006 Vierling ..... 200/400

FOREIGN PATENT DOCUMENTS

DE 19828791 C1 3/2000
DE 69712960 T2 2/2003
DE 29824499 U1 4/2004
EP 1164605 A2 12/2001

OTHER PUBLICATIONS

German Office Action, DE application No. 10 2010 011 907.0, 4 pages.

* cited by examiner

*Primary Examiner* — Edwin A. Leon
(74) *Attorney, Agent, or Firm* — King & Spalding L.L.P.

(57) ABSTRACT

A drive apparatus for a tensioning shaft of a spring energy drive of an electric switch has a kinematic chain for connecting a drive element to the shaft and a control element. Within the chain, a first link which can be coupled to the shaft in rotationally fixed fashion and a second link arranged coaxially regarding the first link and capable of rotating under the force of the drive element are coupled to one another in a form-fitting and/or force-fitting manner by a coupling element which is moved by the control element on one of the two links such that the link coupling is released when a predetermined first angular link position is reached and is produced again when a predetermined second angular link position is overshot. To provide the drive apparatus with a more compact configuration, the coupling element can be moved in the radial direction of the shaft.

12 Claims, 11 Drawing Sheets

DRIVE APPARATUS FOR A TENSIONING SHAFT OF A SPRING ENERGY DRIVE OF AN ELECTRIC SWITCH AND ELECTRIC SWITCH WITH SUCH A DRIVE APPARATUS

CROSS-REFERENCE TO RELATED APPLICATIONS

This application claims priority to DE Patent Application No. 10 2010 011 997.0 filed Mar. 18, 2010. The contents of which is incorporated herein by reference in its entirety.

TECHNICAL FIELD

The invention relates to the structural configuration of a drive apparatus for a tensioning shaft of a spring energy drive of an electric switch.

The invention furthermore relates to an electric switch with such a drive apparatus and with a spring energy drive, which has a tensioning shaft capable of being coupled to the drive apparatus and which is used in particular for actuating switching contacts.

BACKGROUND

Documents DE 298 24 499 U1, U.S. Pat. No. 4,649,244 A and EP 1 164 605 B1 have disclosed electric switches of the generic type. Said switches each have a drive apparatus of the generic type in the form of an electric motor drive apparatus, with a spring energy store of the spring energy drive being latched in the tensioned state by means of a switching mechanism.

If, in the case of these switches, the latching of the spring energy store only brings with it disconnection of the electric motor drive apparatus, there is the risk of overtravel of the electric motor drive apparatus resulting in distortions in the spring energy drive. It is therefore advantageous if the latching of the spring energy store also causes the transmission of forces of the drive apparatus to the tensioning shaft to end.

In order to ensure this, in the case of the switch known from document U.S. Pat. No. 4,649,244 A, for example, a kinematic chain of the drive apparatus which connects a drive element in the form of a motor shaft to the tensioning shaft can be interrupted and closed again under the action of a control element. In this case, the interruption of the kinematic chain takes place shortly after the beginning of a latching phase, which follows on from a tensioning phase, when a predetermined first angular position of a first link, which is capable of being coupled to the tensioning shaft in a manner fixed against rotation, of the kinematic chain is reached. The kinematic chain is closed, triggered by the release of the latching of the spring energy drive, shortly after the beginning of a tension-release phase, which follows on from the latching phase, when a predetermined second angular position of this first element, which is capable of being coupled to the tensioning shaft in a manner fixed against rotation, is overshot.

In the case of the switch known from document DE 298 24 499 U1, the drive apparatus for the tensioning shaft of the spring energy drive likewise has a kinematic chain for connecting a drive element to the tensioning shaft and a control element. In this case, the control element consists of a control link arranged on the tensioning shaft in a manner fixed against rotation, an actuating lever, which rests movably on a coupling end of the tensioning shaft and is provided with ramp-like cams and an actuating slide, which is axially displaceable, is provided with mating pieces with respect to the ramp-like cams and acts on a coupling element. With this drive apparatus, a first link, which is coupled to the tensioning shaft in a manner fixed against rotation, and a second link, which is arranged coaxially with respect to the first link and is capable of rotating under the force of the drive element, of the kinematic chain are coupled to one another in a form-fitting and force-fitting manner by the coupling element. The first link is in this case formed by the coupling end of the tensioning shaft. A shaft of the electric motor drive apparatus on which the coupling element is held in a manner fixed against rotation but axially displaceable forms the second link, with the coupling element being moved under the action of the control element in the axial direction of the tensioning shaft on the second link in such a way that its coupling to the first link is eliminated when a predetermined first angular position of the first link is reached and is produced again when a predetermined second angular position of the first link is overshot.

SUMMARY

According to various embodiments, the drive apparatus can be provided with a more compact configuration.

According to an embodiment, a drive apparatus for a tensioning shaft of a spring energy drive of an electric switch comprises: a kinematic chain for connecting a drive element to the tensioning shaft and a control element, in which drive apparatus a first link, which is capable of being coupled to the tensioning shaft in rotationally fixed fashion, and a second link, which is arranged coaxially with respect to the first link and is capable of rotating under the force of the drive element, in the kinematic chain are coupled to one another in a form-fitting and/or force-fitting manner by a coupling element, the coupling element being moved under the action of the control element on one of the two links in such a way that the coupling between this link and the other of the two links is released when a predetermined first angular position of the first link is reached and is produced again when a predetermined second angular position of the first link is overshot, wherein the coupling element is capable of moving in the radial direction of the tensioning shaft.

According to a further embodiment, the coupling element can be supported by means of a spring in an accommodating opening in one of the two links, said accommodating opening extending in the radial direction of the tensioning shaft, and engages in an accommodating area of the other of the two links, said accommodating area being radially opposite the accommodating opening, wherein the coupling element being pushed out of the accommodating area when the predetermined first angular position of the first link is reached for decoupling the two links under the action of the control element counter to the force of the spring and is released by the control element when the predetermined second angular position is overshot for renewed engagement in the accommodating area. According to a further embodiment, the control element may consist of two control contours, which are formed on inner walls of a housing accommodating the drive element and the kinematic chain.

According to another embodiment, an electric switch may comprise a drive apparatus as described above and a spring energy drive, which has a tensioning shaft which can be coupled to the drive apparatus.

BRIEF DESCRIPTION OF THE DRAWINGS

The invention will be explained in more detail below with reference to an exemplary embodiment shown in FIGS. 1 to 16, in which.

DETAILED DESCRIPTION

According to various embodiments, the coupling element is capable of moving in the radial direction of the tensioning shaft.

In contrast to the drive apparatus known from document DE 298 24 499 U1, in the drive apparatus according to various embodiments, no additional installation space is required in the axial direction of the tensioning shaft to interrupt the force transmission.

One configuration of the novel drive apparatus envisages that the coupling element is supported by means of a spring in an accommodating opening in one of the two links, said accommodating opening extending in the radial direction of the tensioning shaft, and engages in an accommodating area of the other of the two links, said accommodating area being radially opposite the accommodating opening, the coupling element being pushed out of the accommodating area when the predetermined first angular position of the first link is reached for decoupling the two links under the action of the control element counter to the force of the spring and is released by the control element when the predetermined second angular position is overshot for renewed engagement in the accommodating area. Preferably, in this case the control element may consist of two control contours, which are formed on inner walls of a housing accommodating the drive element and the kinematic chain.

Figure 1:
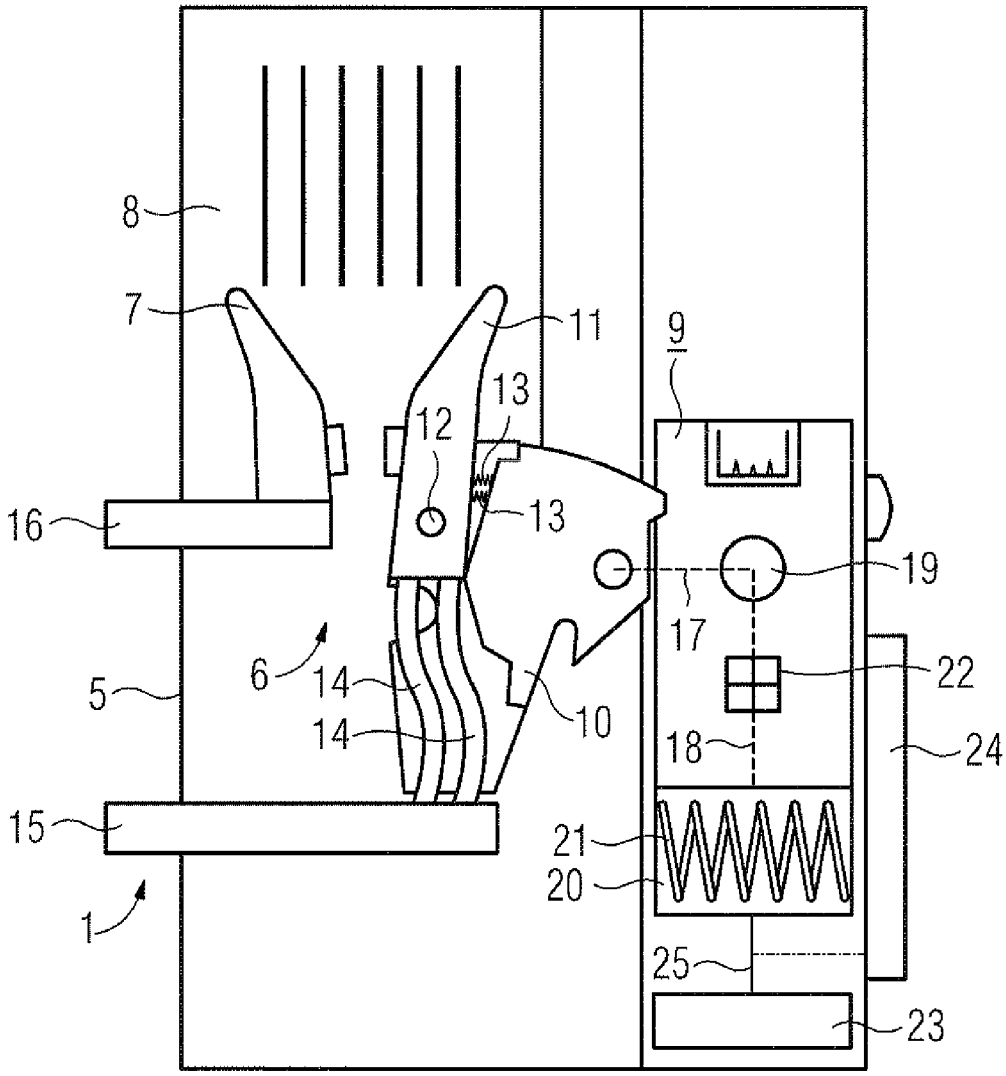
FIG. 1 shows a schematic illustration of an electric switch in the form of a low-voltage circuit breaker with a spring energy drive, which is used for actuating switching contacts and which has a tensioning shaft which is driven by means of an electric motor drive apparatus.
Figure 2:
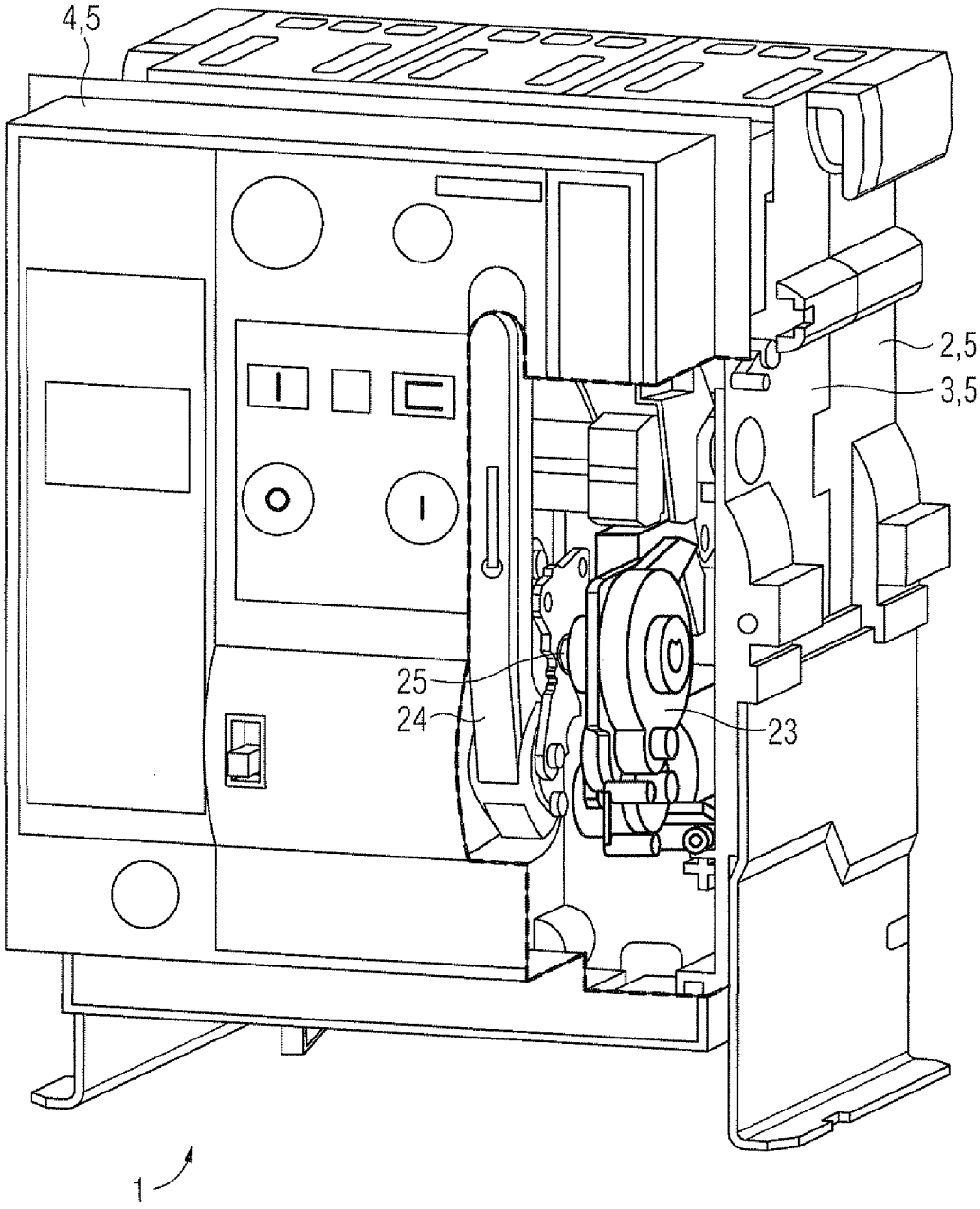
FIG. 2 shows the electric switch shown in FIG. 1 in a perspective illustration with the front cover illustrated partially broken away and with a view of the electric motor drive apparatus and parts of the spring energy drive.
Figure 3:
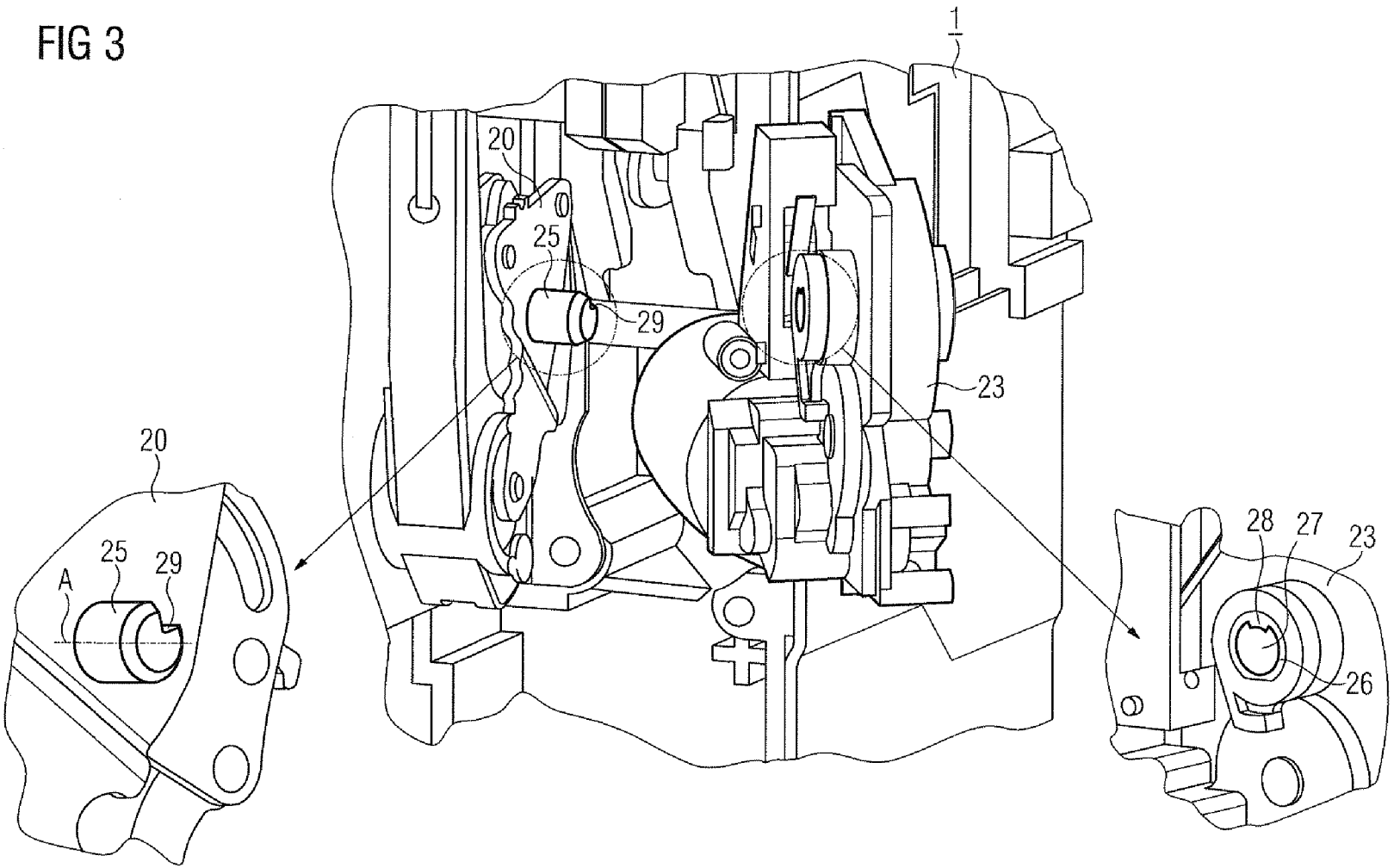
FIG. 3 shows the fitting of the electric motor drive apparatus in the electric switch.

The electric switch 1 shown in FIGS. 1 and 2 in the form of a low-voltage circuit breaker has a housing 5 consisting of two pole half-shells 2, 3 and a cover 4. A contact arrangement, which consists of a movable contact 6 and a fixed contact 7, an arc quenching chamber 8 and a drive mechanism 9 are arranged in the housing. In this case, the drive mechanism serves to actuate the movable contact 6, which has a plurality of contact levers 11 (only one contact lever is shown in the figure), which are arranged parallel to one another and are supported in a pivotable contact carrier 10. The contact levers 11 are fitted pivotably in the contact carrier 10 in a known manner by means of an articulated bolt and are prestressed by in each case two contact force springs 13. Flexible conductors 14 connect the contact levers 11 to a lower terminal bar 15. The fixed contact 7, which is associated with the movable contact 6 of the contact arrangement, is connected to an upper terminal bar 16. The drive mechanism 9 has a drive train for the movable contact 6, said drive train consisting of a first coupling linkage 17 and a second coupling linkage 18 as well as a switching shaft 19. The drive mechanism 9 also includes a spring energy drive 20. The energy for switching the switch on and off, i.e. for closing and opening the contacts 6, 7, can be stored by means of the spring energy drive by tensioning of a spring energy store 21. In order to latch the spring energy drive 20 in its tensioned state or in order to latch the drive train with the contacts 6, 7 closed, the drive mechanism 9 has a switching mechanism 22. An electric motor drive apparatus 23 and a manual drive 24 of the drive mechanism 9 serve to tension the spring energy drive 20. The electric motor drive apparatus 23 and the manual drive 24 are in this case coupled to a tensioning shaft 25 of a tensioning apparatus of the spring energy drive.

In order for it to be coupled to the tensioning shaft 25, the electric motor drive apparatus 23 has a first link 26 which is capable of being coupled to the tensioning shaft 25 in a manner fixed against rotation. This first link is provided with an opening 27, in which the tensioning shaft 25 engages once it has been fitted. In this case, a projection 28 of the first link 26, said projection protruding into the opening 27, corresponds to a groove 29 in the tensioning shaft 25.

As shown in FIGS. 4 to 7, the electric motor drive apparatus is coupled to the spring energy store 21 during a tensioning phase of the spring energy drive via the tensioning shaft 25, a cam disk 30, which is arranged on the tensioning shaft 25 in a manner fixed against rotation, and a lever system 31 and is decoupled from the lever system 31 and therefore also from the spring energy store 21 during a latching phase of the spring energy drive, in a manner known from document EP 1 164 605 B1.

In contrast to the drive mechanism known from document U.S. Pat. No. 4,649,244 A, in this case the spring energy drive is latched in its tensioned state not by means of the cam disk 30, but, after decoupling of the lever system 31, separately from the cam disk 30 by means of the switching mechanism denoted by 19 in FIG. 1, as is already known from document EP 1 382 049 B1.

In the manner known from document EP 1 164 605 B1, the tensioning apparatus of the spring energy drive has, in addition to the tensioning shaft 25, the cam disk 30 and the lever system 31, a safety catch 32 as well. The lever system is formed by a roller lever 34, which bears a scanning roller 33, and a tensioning lever 35, which is articulated on the spring energy store 21. The roller lever 34 and the tensioning lever 35 are connected by means of a coupling link 36. The roller lever 34 is arranged rotatably on a first bearing bolt 37 and the tensioning lever 35 is arranged rotatably on a second bearing bolt 38. The roller lever 34 and the coupling link 36 are connected by means of a first bolt 39 and the tensioning lever 35 and the coupling link 36 are connected by means of a second bolt 40. The position of the coupling link 36 is thus dependent firstly on the position of the roller lever 34 and secondly on the position of the tensioning lever 35. In this case, the tensioning lever 35 is in the form of a two-armed lever, with one arm 41 being articulated on the coupling link 36 and the other arm 42 being articulated on the spring energy store 21. The spring energy store 21 has the function of providing the energy required for a switching operation for actuating the switching contacts and is in the form of a helical compression spring. The cam disk is arranged fixedly on the tensioning shaft 25, and said tensioning shaft 25 is capable of rotating about its axis A in the clockwise direction by means of the electric motor drive apparatus denoted by 23 in FIGS. 1 and 2 and the manual drive denoted by 24 in FIGS. 1 and 2. The cam disk 30 and the lever system 31 are coupled so as to transmit the drive force of the drive apparatus 23 or the counteracting spring force of the spring energy store 21 as soon as the scanning roller 33 borne by the roller lever 34 bears against the circumferential edge 41 of the cam disk 30. Furthermore, a cam plate 42 is arranged on the tensioning shaft 25 and can be used to actuate a position switch 43. By actuation of the position switch 43 by the cam plate 42 depending on the position of the tensioning shaft 25 or the cam disk 30, which is connected fixedly thereto, the drive apparatus can be switched so as to be operation-ready or not operation-ready. The safety catch 32 has a projection 44 in the form of a stop cam on the cam disk 30 and a hook-like protrusion 45 formed on the coupling link 36.

Figure 4:
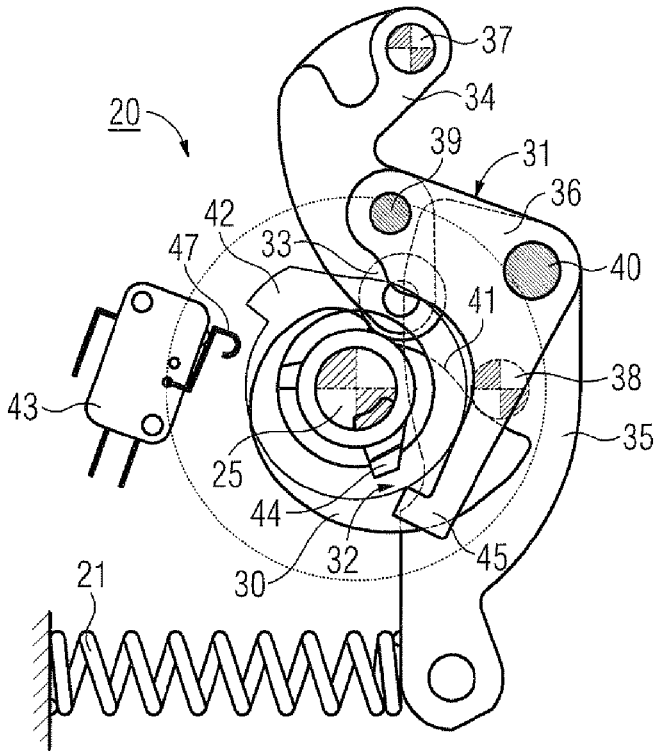
FIGS. 4 to 7 show a detail of the spring energy drive in various phases during tensioning and tension-release of its spring energy store.

FIG. 4 shows the tensioning apparatus at the beginning of the tensioning phase. At this time, the cam disk 30 is located in its initial position and the scanning roller 33 borne by the roller lever 34 bears against the peripheral edge 41 of the cam disk 30. The lever system 31 is located in a first position, in which the spring energy store 21 is completely relieved of tension. The position switch 43 is open, as a result of which the drive apparatus is switched so as to be operation-ready. The cam disk 30 and the safety catch 32, formed from the projection 44 and the hook-like protrusion 45, are decoupled from one another since the hook-like protrusion of the coupling link 36 is not engaging behind the projection 44. If the electric motor drive apparatus is switched on, the tensioning shaft 25, which is coupled to the drive apparatus, and therefore the cam disk 30 begin to rotate in the clockwise direction. Owing to the resultant increase in the distance between the peripheral edge 41 of the cam disk 30 and the fulcrum of the cam disk, the roller lever 34 is pivoted towards the right about the first bearing bolt 37. The movement of the roller lever 34 is transmitted by means of the coupling link 36 onto the tensioning lever 35, with the result that that arm 42 of the tensioning lever 35 which is articulated on the spring energy store 21 is pivoted towards the left about the second bearing bolt 38 and therefore the spring energy store 21 is tensioned. In this case, the coupling element 36 of the lever system 31 is at the same time moved along in such a way that the hook-like protrusion 45 pivots into the movement path of the projection 44.

Figure 5:
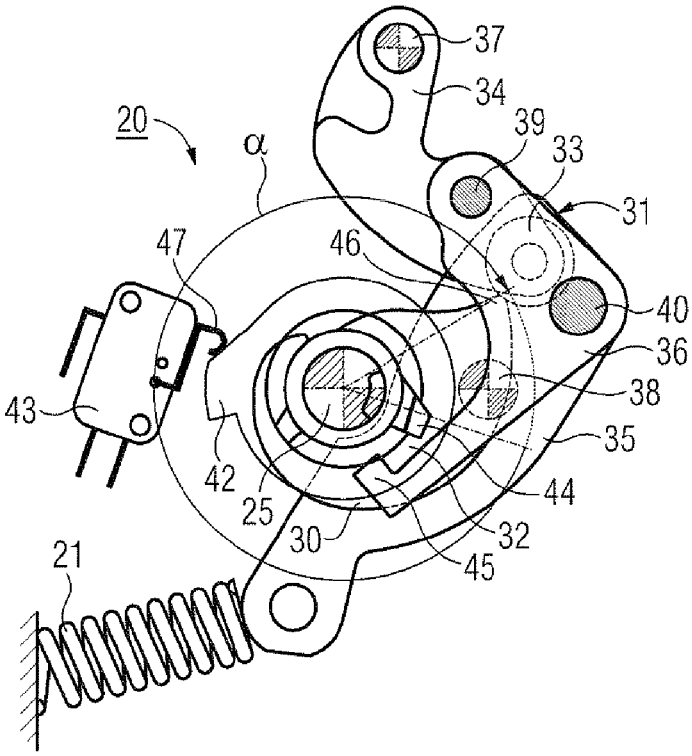

As shown in FIG. 5, which shows the tensioning apparatus at the end of the tensioning phase, the cam disk 30 is rotated about a first angle $\alpha$ in the clockwise direction with respect to its initial position. The scanning roller 33 bears against the cam disk 30 shortly before a recessed region of the peripheral edge 41 of the cam disk. The lever system 31 is located in a second position, in which the spring energy store is completely tensioned. The cam plate 42 operates in opposition to the movable contact 47 of the position switch 43, as a result of which the position switch 43 is closed. When the position switch is closed, the drive apparatus is switched off and is not operation-ready. During the subsequent latching phase, the cam disk 30 rotates further in the clockwise direction under the action of the kinetic residual energy of the switched-off drive apparatus 23, with the scanning roller 33 no longer bearing against the cam disk 30 owing to the recessed region 46 of the peripheral edge. The spring energy drive 20 is latched by means of the switching mechanism.

Figure 6:
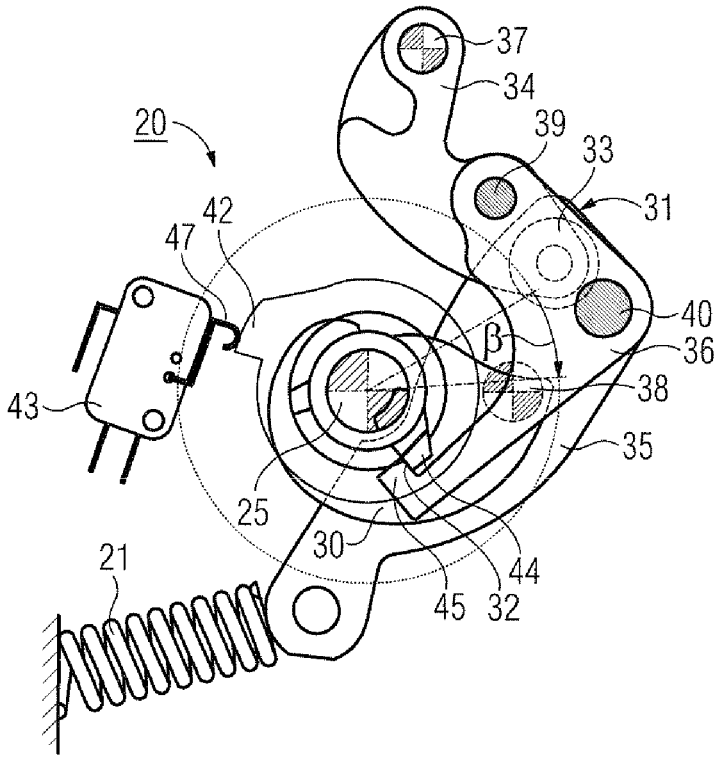

As shown in FIG. 6, after a rotation through a second angle $\beta$ which is smaller than the difference between 360° and the first angle $\alpha$, the cam disk 30 is brought to a standstill by virtue of the fact that the projection 44 operates in opposition to the hook-like protrusion 45 engaging behind said projection. In this case, the position switch 43 remains closed by means of the cam plate 42 bearing against said position switch, with the result that the drive apparatus is prevented from being switched on again prematurely.

Figure 7:
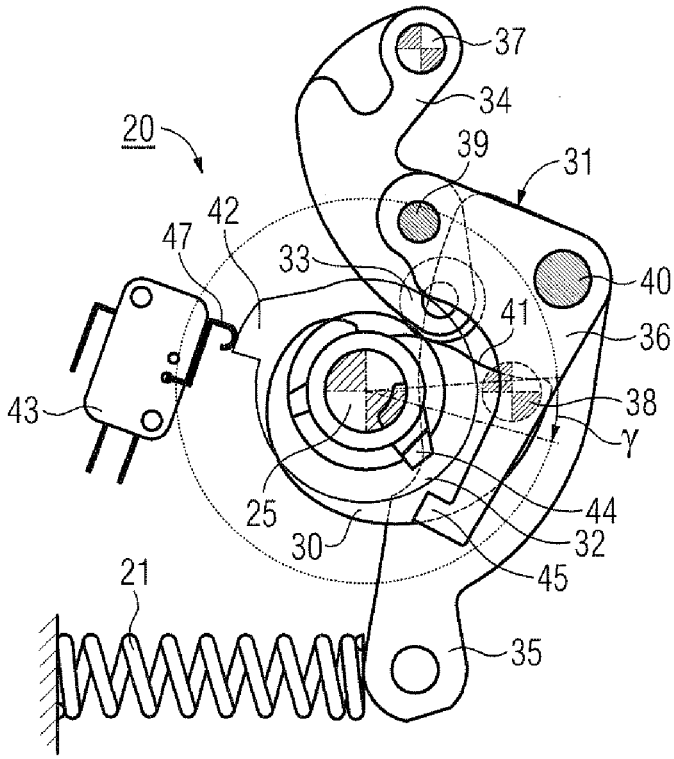
Figure 8:
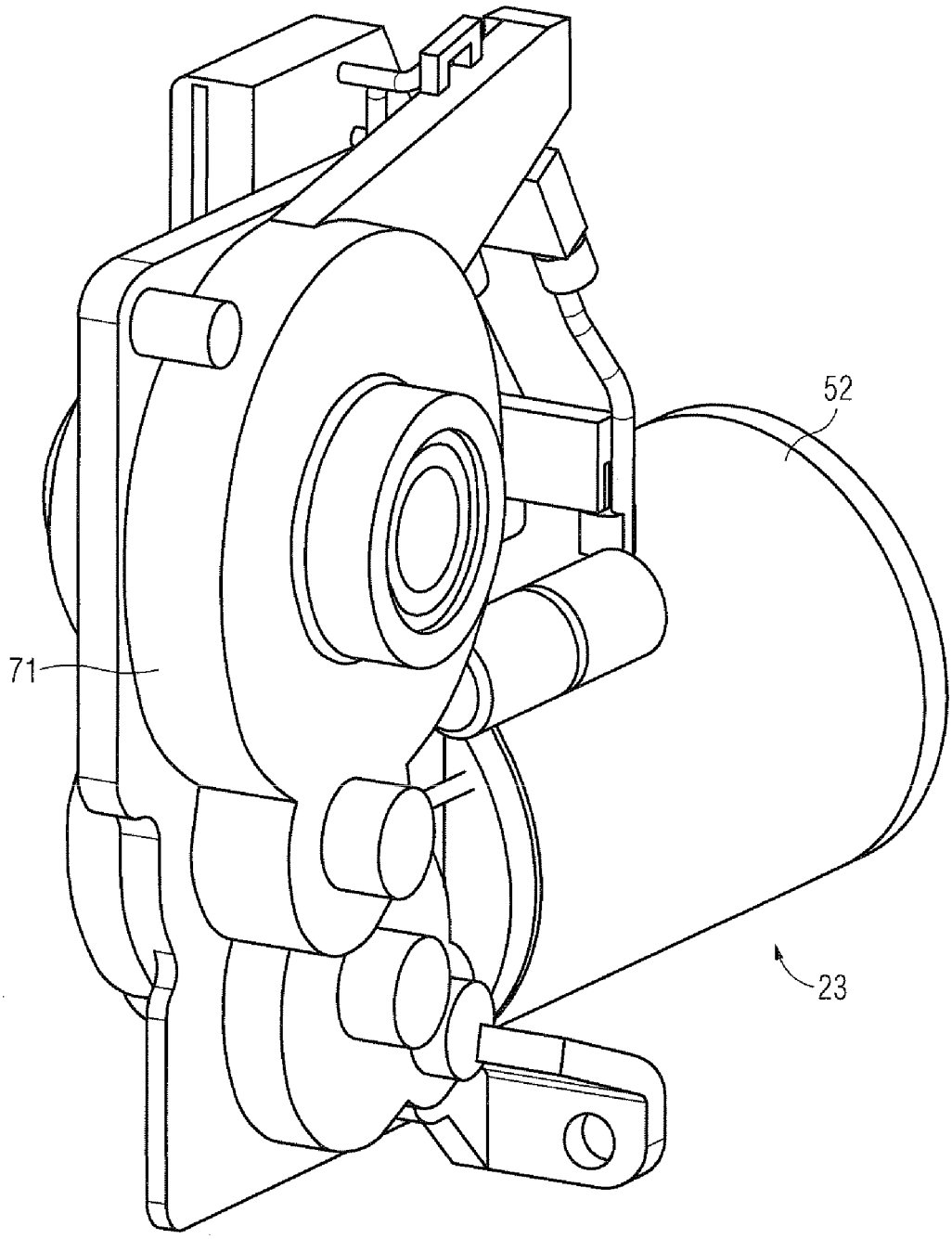
FIG. 8 shows the electric motor drive apparatus shown in FIG. 2 in an enlarged illustration with a drive element in the form of a motor and with a housing for accommodating a kinematic chain, which connects the drive element to the tensioning shaft.

As shown in FIG. 7, by virtue of the switching mechanism being released during the tension-release phase, triggered thereby, of the spring energy drive 20, the lever system 31 is pivoted back out of the second position into the first position under the action of the force of the spring energy store 21. In the process, the projection 44 is released by the hook-like protrusion 45 before the scanning roller 33 rests on the peripheral edge 41 of the cam disk, as a result of which the lever system 31 and the cam disk 30 are coupled again. Owing to this coupling, the cam disk 30 is rotated through a third angle $\gamma$, which corresponds to the difference between 360° and the sum of the two other angles $\alpha+\beta$, under the action of the force of the spring energy store 21 until it reaches its initial position (cf. FIG. 1). At the same time, the movable contact 47 of the position switch 43 is released by the cam plate 42 and switches the drive apparatus 23 so as to be operation-ready again.

The tensioning apparatus therefore secures a reproducible initial position of the cam disk 30, irrespective of a fluctuating residual torque of the electric motor drive apparatus 23 which is switched off at the end of the tensioning phase.

However, this residual torque of the drive apparatus 23 can result in distortions and damage to the spring energy drive in particular in the region of the safety catch 32.

In order to prevent this, in practice a drive element in the form of a motor of the drive apparatus is braked electrically by means of an electric motor brake. Such electric motor brakes are susceptible to the action of electromagnetic interference sources, however.

In the case of the electric switch 1 according to various embodiments, provision is made for the transmission of the residual torque of the drive apparatus 23 to the tensioning apparatus of the spring energy drive 20 to be suppressed mechanically.

Figure 10:
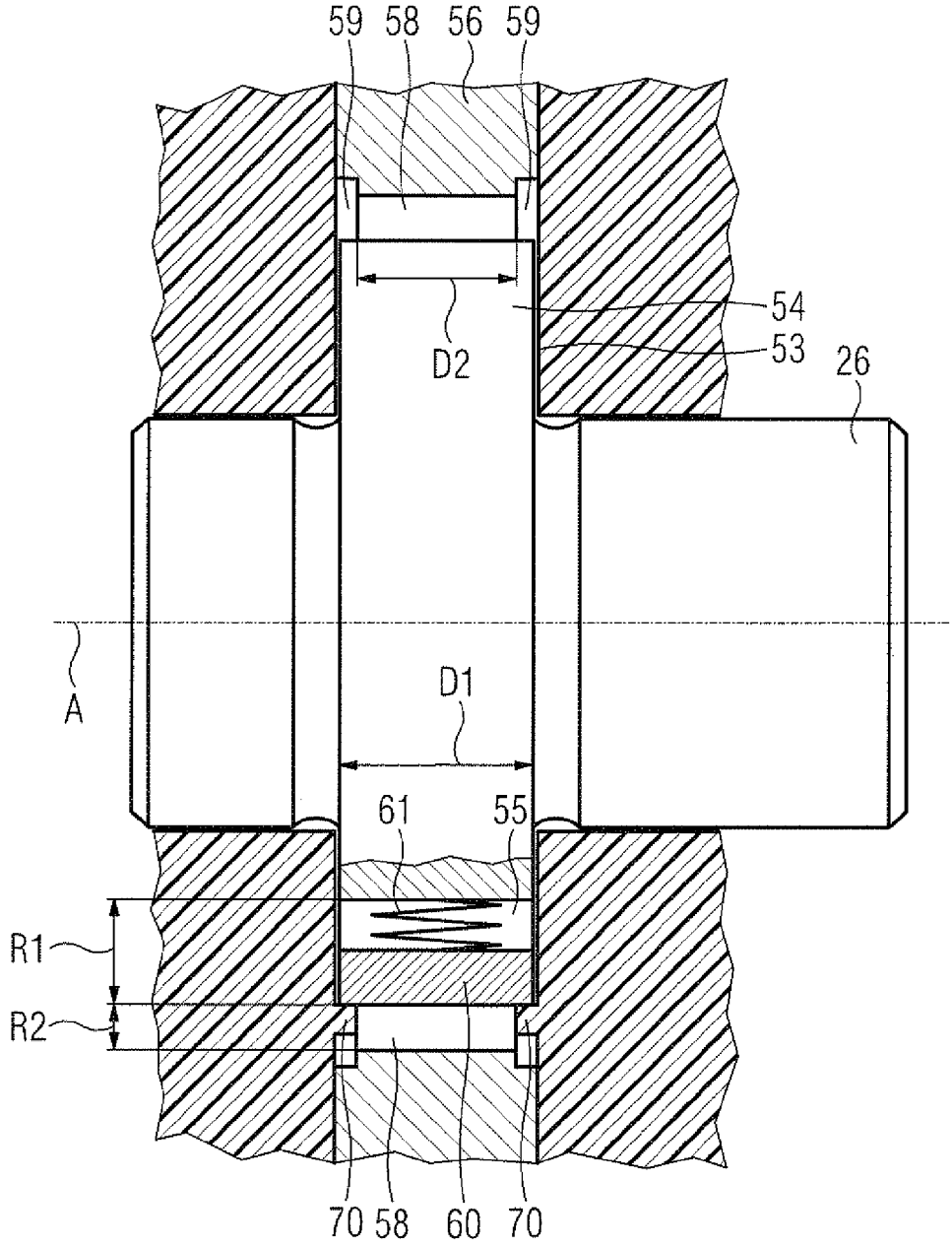
FIG. 10 shows a detail of the electric motor drive apparatus, partially sectioned along a line IX-IX shown in FIG. 9.
Figure 11:
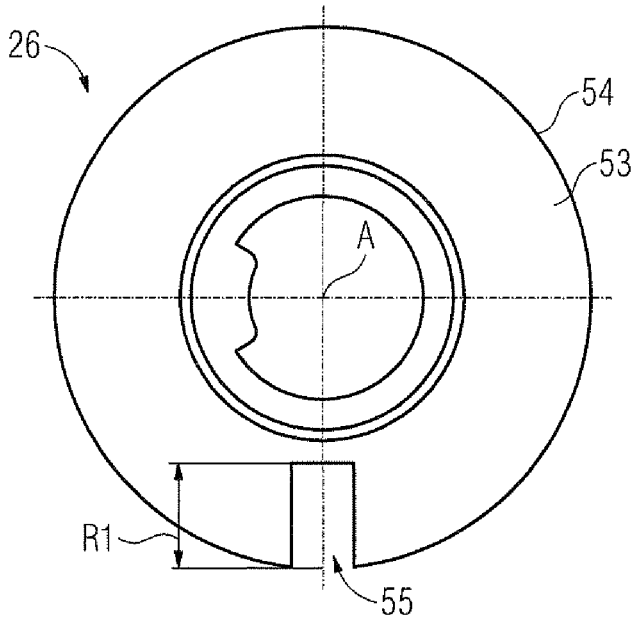
FIG. 11 shows a view of a first link of the kinematic chain which is capable of being coupled to the tensioning shaft in a manner fixed against rotation.

For this purpose, a kinematic chain 50 (shown in FIG. 9) of the drive apparatus 23 is interrupted mechanically. This kinematic chain 50 connects a drive element 51 in the form of a motor shaft of a motor 52 to the tensioning shaft 25. In this case, the first link 26, which forms an inner ring (denoted by 53 in FIGS. 10 and 11) of a one-way coupling, forms one end of the kinematic chain 50. This first link 26 has an accommodating opening 55, which is open towards the outer lateral surface 54 and extends in the form of a right-parallelepipedal longitudinal groove which is open at one end in the axial direction of the tensioning shaft (in the direction of the axis A) over the entire thickness (denoted by D1 in FIG. 10) of the inner ring 53 and in the radial direction of the tensioning shaft over a limited length R1.

Figure 12:
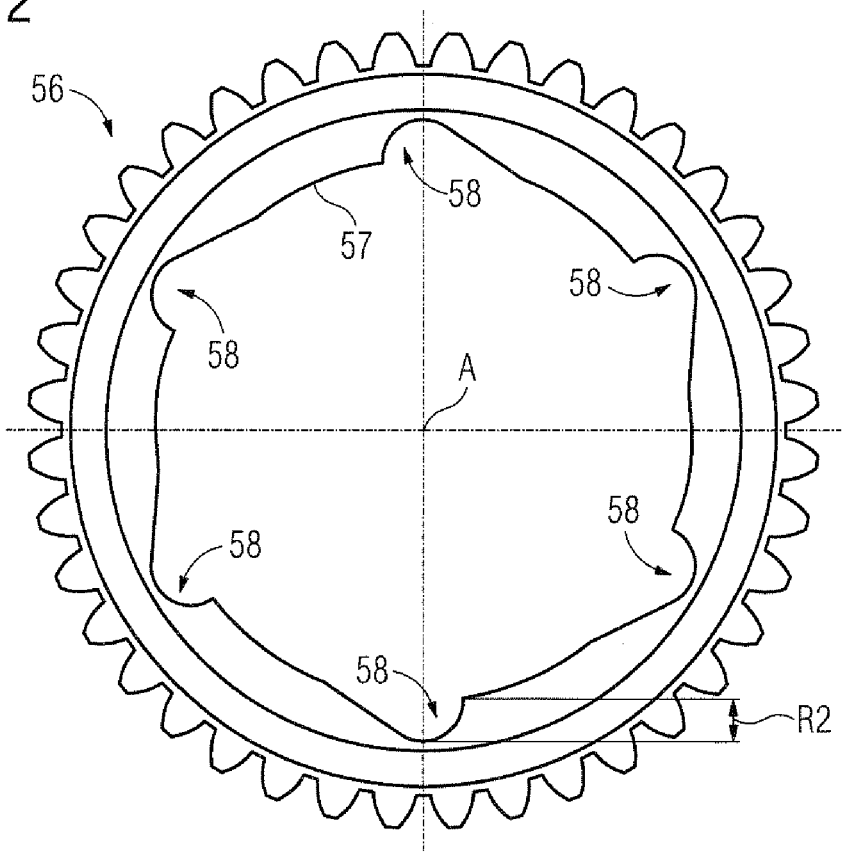
FIG. 12 shows a second link of the kinematic chain which is capable of rotating under the force of the drive element.

A second link 56 (denoted by 56 in FIGS. 10 and 12) of the kinematic chain which is arranged coaxially with respect to the first link 26 is in the form of an outer ring of the one-way coupling and has six rotationally symmetrically arranged accommodating areas 58, which are open towards the inner lateral surface 57 and extend in the region of two cylinder depressions 59 in the form of semicircular-cylindrical longitudinal grooves which are open at the end in the axial direction of the tensioning shaft over the thickness (denoted by D2 in FIG. 10) of the second link and in the radial direction of the tensioning shaft over a limited radius R2.

A coupling element 60 of the one-way coupling, said coupling element 60 being in the form of a clamping roller, is supported by means of a spring 61 in the accommodating opening in the first link 26 and engages in one of the accommodating areas 58 of the second link 56 which are radially opposite this accommodating opening. By virtue of the form-fitting and force-fitting connection with the coupling element 60, the two links 26, 56 are coupled to one another indirectly via the coupling element 60. In this case, the length R1 of the accommodating opening 55 is selected such that the coupling element 60 can be moved so far into the accommodating opening 55, counter to the force of the spring, in the radial direction of the tensioning shaft that it does not protrude beyond the outer lateral surface 54.

The drive element 51 is coupled to the second link 56 by means of pairs of gearwheels 65, 66, 67, 68 via three further links 62, 63, 64 of the kinematic chain which are in the form of gearwheel elements, with the result that the second link is capable of rotating in the clockwise direction under the force of the drive element.

Figure 9:
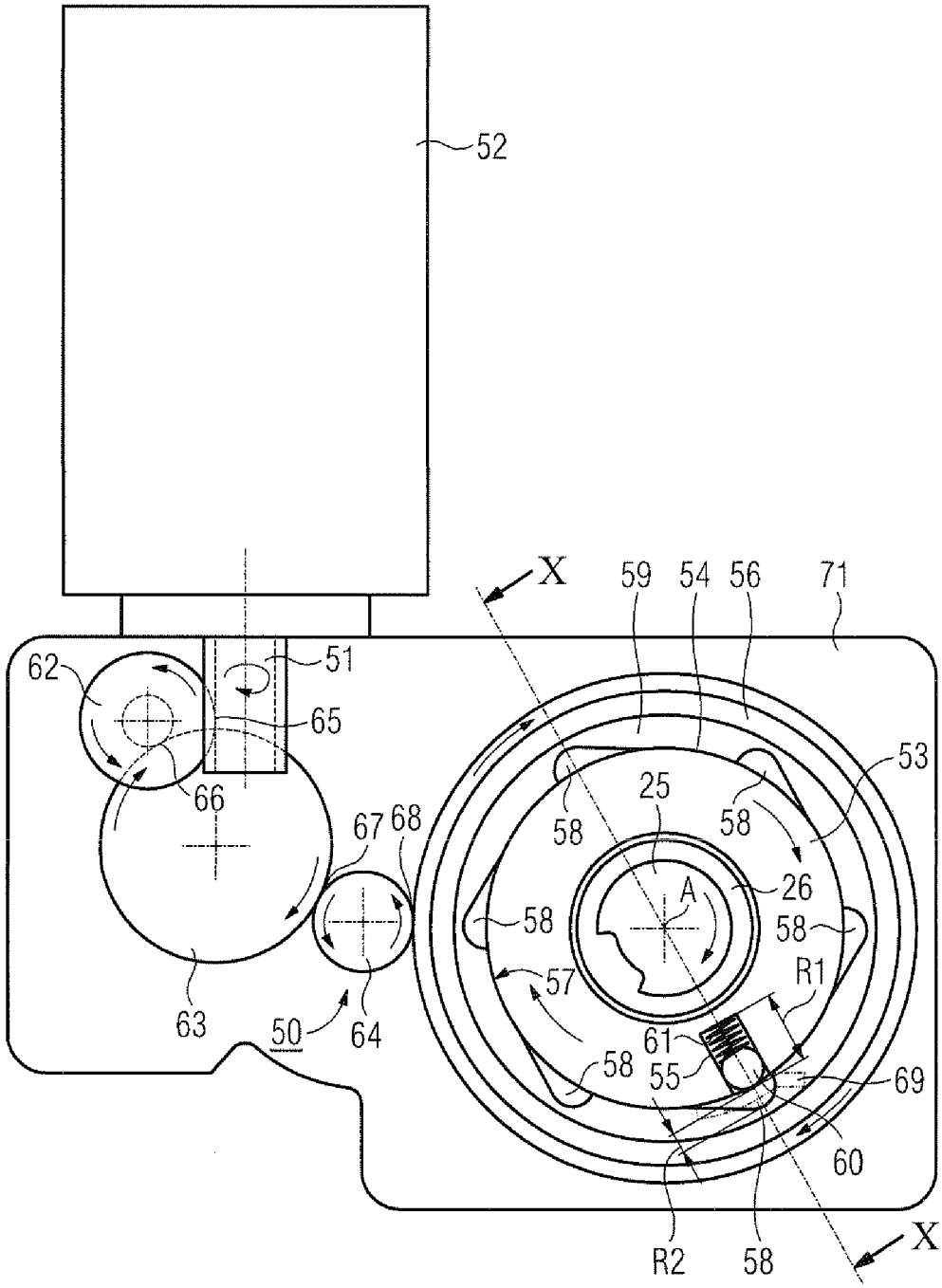
FIG. 9 shows the electric motor drive apparatus with the housing open with a view of the kinematic chain.

The drive apparatus 23 according to various embodiments has, in addition to the kinematic chain 50, a control element denoted overall by 69 in FIG. 9. This control element in FIG. 10 consists of two control contours 70, which are formed on mutually opposite inner walls of a housing 71 accommodating the drive element 51 and the kinematic chain 50. Each of the two control contours 70 of the control element 69 is in this case guided in one of the cylinder depressions 59 in the second link 56.

As shown in FIGS. 13 to 16, the coupling element 60 is moved under the action of the control element 69 on the first link 26 in such a way that its coupling to the second link 56 is eliminated when a predetermined first angular position of the first link is reached and is produced again when a predetermined second angular position of the first link is reached.

Figure 13:
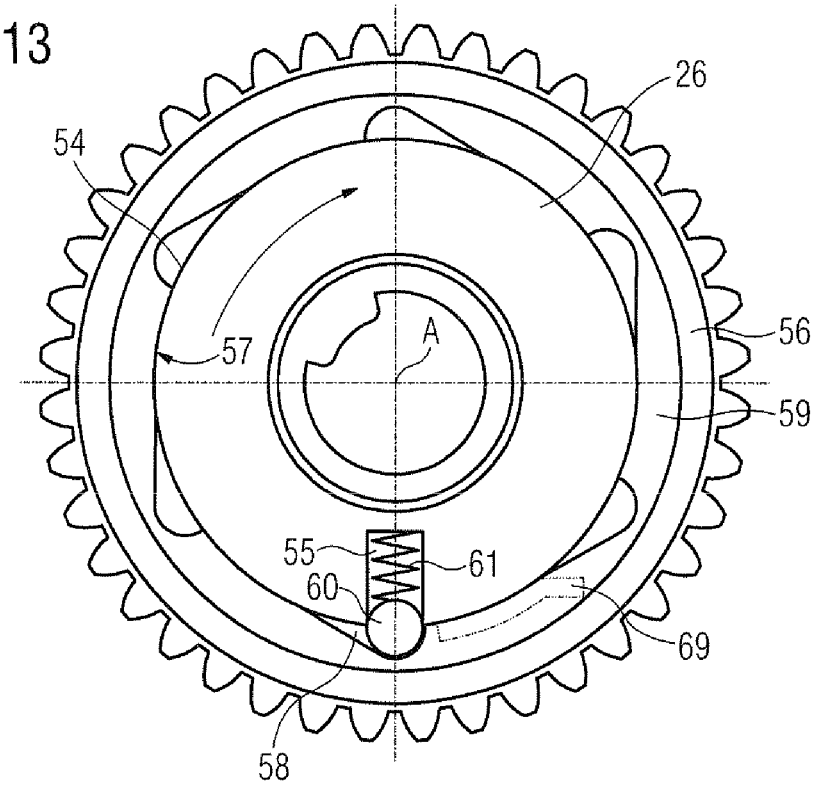
FIGS. 13 to 16 show a section of the kinematic chain with the first link which is capable of being coupled to the tensioning shaft in a manner fixed against rotation and with the second link, which is arranged coaxially with respect to the first link and is capable of rotating under the force of the drive element, in various phases, in an illustration similar to those in FIGS. 1 to 4.

Thus, FIG. 13 shows the two links 26, 56 at the beginning of the tensioning phase in their initial position. Under the force of the spring 61, the coupling element 60 protrudes half into the accommodating opening 55 and half into the accommodating area 58, with the result that the two links are coupled to one another. Under the force of the drive element, the second link 56 begins to rotate in the clockwise direction and in the process indirectly drives the first link 26 also in the clockwise direction via the coupling element 60.

Figure 14:
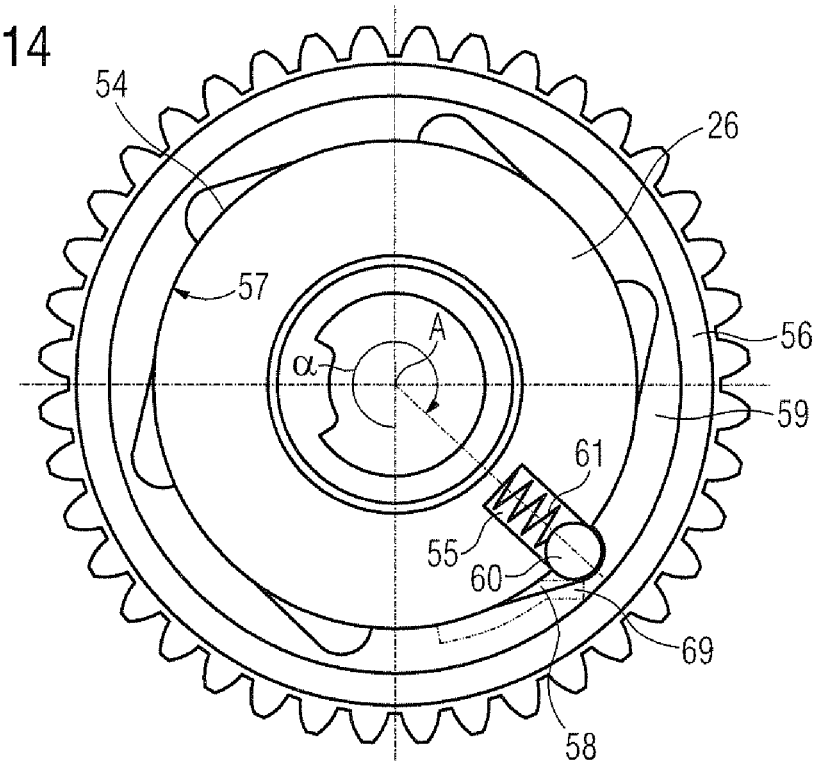

As shown in FIG. 14, the links 26, 56 are rotated in the clockwise direction through the first angle $\alpha$ with respect to their initial position at the end of the tensioning phase and have therefore reached a predetermined first angular position, in which the coupling element 60 is pushed out of the accommodating area 58 under the action of the control element 69 counter to the force of the spring 61 so as to decouple the first link 26 from the second link 56.

Figure 15:
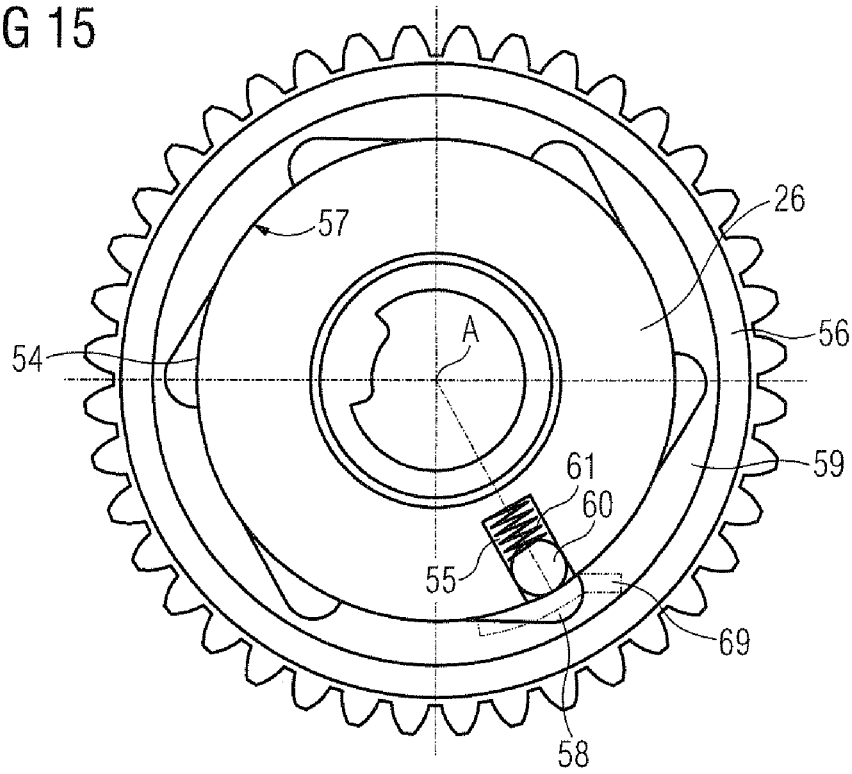

FIG. 15 shows an intermediate position of the first link 26, in which it is already completely decoupled from the second link 56.

Figure 16:
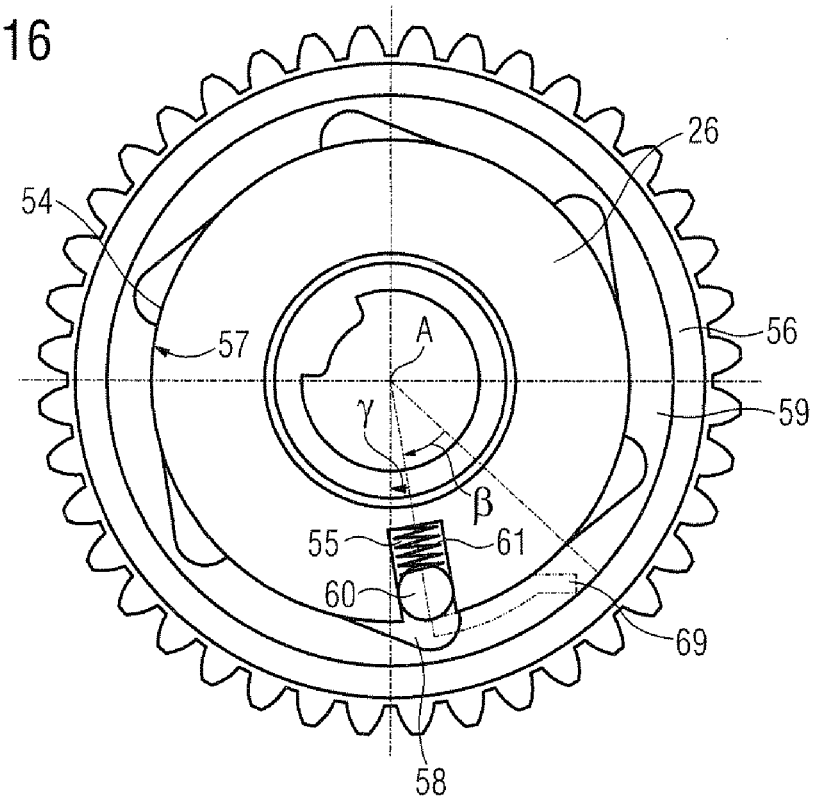

As shown in FIG. 16, after a further rotation about the second angle $\beta$, the first link 26 reaches a predetermined second angular position, in which the first link 26 has likewise been brought to a standstill by the cam disk 30 being brought to a standstill. The second link can rotate further freely as a result of the residual torque of the electric motor drive apparatus, which is switched off at the end of the tensioning phase, without a force being transmitted to the first link 26.

During the tension-release phase of the spring energy drive, the first link is rotated, together with the cam disk, under the action of force of the spring energy store through the third angle $\gamma$ until it reaches its initial position (cf. FIG. 4) and therefore overshoots the predetermined second angular position shown in FIG. 16. When the predetermined second angular position is overshot, the coupling element 60 is released by the control element 69 so as to engage in one of the accommodating areas 58 again, with this engagement taking place once the electric motor drive apparatus has been switched on again.

What is claimed is:

1. A drive apparatus for a tensioning shaft of a spring energy drive of an electric switch, the drive apparatus comprising:

a kinematic chain for connecting a drive element to the tensioning shaft, and a control element, wherein a first link of the kinematic chain, which first link is capable of being coupled to the tensioning shaft in rotationally fixed fashion, and a second link of the kinematic chain, which second link is arranged coaxially with respect to the first link and is capable of rotating under the force of the drive element, are coupled to one another in at least one of a form-fitting manner and a force-fitting manner by a coupling element, and wherein the coupling element is movable by the control element acting on one of the two links in such a way that the coupling between this link and the other of the two links is released when a predetermined first angular position of the first link is reached and is produced again when a predetermined second angular position of the first link is overshot, wherein the coupling element is capable of moving in the radial direction of the tensioning shaft.

2. The drive apparatus according to claim 1, wherein the coupling element is supported by means of a spring in an accommodating opening in one of the two links, said accommodating opening extending in the radial direction of the tensioning shaft, and engages in an accommodating area of the other of the two links, said accommodating area being radially opposite the accommodating opening, wherein the coupling element being pushed out of the accommodating area when the predetermined first angular position of the first link is reached for decoupling the two links under the action of the control element counter to the force of the spring and is released by the control element when the predetermined second angular position is overshot for renewed engagement in the accommodating area.

3. The drive apparatus according to claim 1, wherein the control element consists of two control contours, which are formed on inner walls of a housing accommodating the drive element and the kinematic chain.

4. The drive apparatus according to claim 2, wherein the control element consists of two control contours, which are formed on inner walls of a housing accommodating the drive element and the kinematic chain.

5. An electric switch comprising:

a drive apparatus, and a spring energy drive having a tensioning shaft configured to be coupled to the drive apparatus, wherein the drive apparatus comprises a kinematic chain for connecting a drive element to the tensioning shaft and a control element, wherein the kinematic chain comprises a first link, which is capable of being coupled to the tensioning shaft in rotationally fixed fashion, and a second link, which is arranged coaxially with respect to the first link and is capable of rotating under the force of the drive element, wherein the first and second links are coupled to one another in at least one of a form-fitting manner and a force-fitting manner by a coupling element, and wherein the coupling element is movable by the control element acting on one of the two links in such a way that the coupling between this link and the other of the two links is released when a predetermined first angular position of the first link is reached and is produced again when a predetermined second angular position of the first link is overshot, wherein the coupling element is capable of moving in the radial direction of the tensioning shaft.

6. The electric switch according to claim 5, wherein the coupling element is supported by means of a spring in an accommodating opening in one of the two links, said accommodating opening extending in the radial direction of the tensioning shaft, and engages in an accommodating area of the other of the two links, said accommodating area being radially opposite the accommodating opening, wherein the coupling element being pushed out of the accommodating area when the predetermined first angular position of the first link is reached for decoupling the two links under the action of the control element counter to the force of the spring and is released by the control element when the predetermined second angular position is overshot for renewed engagement in the accommodating area.

7. The electric switch according to claim 5, wherein the control element consists of two control contours, which are formed on inner walls of a housing accommodating the drive element and the kinematic chain.

8. The electric switch according to claim 6, wherein the control element consists of two control contours, which are formed on inner walls of a housing accommodating the drive element and the kinematic chain.

9. A method for operating a spring energy drive of an electric switch, wherein the electric switch comprises a kinematic chain for connecting a drive element to a tensioning shaft and further comprises a control element, wherein a first link of the kinematic chain, which is capable of being coupled to the tensioning shaft in rotationally fixed fashion, and a second link of the kinematic chain, which is arranged coaxially with respect to the first link and is capable of rotating under the force of the drive element, are coupled to one another in at least one of a form-fitting manner and a force-fitting manner by a coupling element, the method comprising:

moving the coupling element by the control element acting on one of the two links in such a way that the coupling between this link and the other of the two links is released when a predetermined first angular position of the first link is reached and is produced again when a predetermined second angular position of the first link is overshot, wherein the coupling element is capable of moving in the radial direction of the tensioning shaft.

10. The method according to claim 9, wherein the coupling element is supported by means of a spring in an accommodating opening in one of the two links, said accommodating opening extending in the radial direction of the tensioning shaft, and engages in an accommodating area of the other of the two links, said accommodating area being radially opposite the accommodating opening, wherein the coupling element being pushed out of the accommodating area when the predetermined first angular position of the first link is reached for decoupling the two links under the action of the control element counter to the force of the spring and is released by the control element when the predetermined second angular position is overshot for renewed engagement in the accommodating area.

11. The method according to claim 9, wherein the control element consists of two control contours, which are formed on inner walls of a housing accommodating the drive element and the kinematic chain.

12. The method according to claim 10 the control element consists of two control contours, which are formed on inner walls of a housing accommodating the drive element and the kinematic chain.

* * * * *